United States Patent [19]

Burdette

[11] 4,087,257

[45] May 2, 1978

[54] HIGH DENSITY-HIGH VOLUMETRIC HEATING VALUE LIQUID RAMJET

[75] Inventor: George W. Burdette, Ridgecrest, Calif.

[73] Assignee: The United States of America as represented by the Secretary of the Navy, Washington, D.C.

[21] Appl. No.: 779,657

[22] Filed: Mar. 21, 1977

[51] Int. Cl.[2] ..... C10L 1/04
[52] U.S. Cl. ..... 44/80
[58] Field of Search ..... 44/80

[56] References Cited

U.S. PATENT DOCUMENTS

| | | | |
|---|---|---|---|
| 1,879,118 | 9/1932 | Davidson | 44/80 |
| 2,211,732 | 8/1940 | Sachanen et al. | 44/80 |
| 3,282,663 | 11/1966 | Muller et al. | 44/80 |
| 3,377,398 | 4/1968 | Zoche | 44/80 |

*Primary Examiner*—Allen B. Curtis
*Assistant Examiner*—Y. Harris-Smith, Mrs.
*Attorney, Agent, or Firm*—R. S. Sciascia; Roy Miller; Lloyd E. K. Pohl

[57] ABSTRACT

A fuel consisting essentially of about 80 weight percent hydrogenated norbornadiene dimer and about 20 weight percent of a butylbenzene has a balance among volumetric heat of combustion, viscosity and flash point such that the fuel is suitable for use in the Modern Ramjet Engine.

2 Claims, No Drawings

HIGH DENSITY-HIGH VOLUMETRIC HEATING VALUE LIQUID RAMJET

BACKGROUND OF THE INVENTION

1. Field of the Invention

This invention relates to ramjet fuels.

2. Description of the Prior Art

A high performance ramjet engine commonly referred to as the Modern Ramjet Engine has recently been devoloped for use in military applications. Specifications dealing with the properties of fuels to be used in this engine are more stringent than those for fuels used in older, lower performance engines. Among the specifications are requirements that the fuel have a volumetric heat of combustion in excess of 154,000 B.T.U./gal., a viscosity of less than 177 centipoises at −40° C and a flash point of greater than 60° C. Previously used fuels do not meet these stringent requirements. For example, pure hydrogenated norbornadiene dimer (also known as Shelldyne H and RJ-5) meets the heating requirement but is several times too viscous at −40° C. As other examples, RJ-4 and JP-5, which are well known to be excellent low viscosity fuels, meet the viscosity requirements but are far too low in volumetric heat of combustion to be useful in the Modern Ramjet Engine.

Because previously used fuels were unsuitable for one reason or another, considerable experimentation was carried out. In particular, combinations of hydrogenated norbornadiene dimer, which was known to have a suitable volumetric heat of combustion with various other materials were experimented with in attempts to find a combination having a suitable balance among volumetric heat of combustion, viscosity and flash point. Combinations of hydrogenated norbornadiene dimer with decalin, with TH-dimer, with toluene, with benzene and with many other materials all failed to meet specifications for one reason or another.

SUMMARY OF THE INVENTION

It has now been found that a combination of about 80 weight percent hydrogenated norbornadiene dimer and about 20 weight percent iso-butylbenzene has properties which enable it to meet the volumetric heat of combustion, viscosity and flash point requirements of the Modern Ramjet Engine.

DESCRIPTION OF THE PREFERRED EMBODIMENT

The best mode for practicing this invention merely requires the mixing of about 80 weight percent hydrogenated norbornadiene dimer and about 20 weight percent iso-butylbenzene and the use of this mixture in the Modern Ramjet Engine. Some very minor alternatives are permissible. For example, the relative weight percentages of the two components may be varied by about ±1 percent without destroying the desired balance among the three above-mentioned properties. That is, an 81 weight percent hydrogenated norbornadience dimer - 19 weight percent iso-butylbenzene combination or a combination containing 79 weight percent of the dimer and 21 weight percent iso-butylbenzene may be used. Also, normal butylbenzene may be used in place of iso-butylbenzene. However, in terms of availability and cost, iso-butylbenzene is the best choice.

The above-mentioned properties of an 80 weight percent hydrogenated norbornadiene dimer - 20 weight percent iso-butylbenzene combination are:

Net volumetric heat of combustion = 154,000 B.T.U./gal.;

Viscosity at −40° C = 162 centipoises; and

Flashpoint = 68° C.

In addition, the combination exhibits a high density (1.02 g./ml. at 20° C) and a freezing point below −40° C. The high density allows the fuel to be easily emulsified with water and thus allows for easy extinguishment in case of fire.

In addition to the above-mentioned properties, the fuel meets all other military specifications for fuels for the Modern Ramjet Engine. The fuel is non-corrosive and may be stored for long periods of time with no deleterious results. Insofar as is known by the inventor, this fuel is the only fuel thus far qualified for use in the Modern Ramjet Engine.

It should by pointed out here that while the fuel was developed specifically for the high performance Modern Ramjet Engine it is completely suitable for use in older, lower performance engines.

What is claimed is:

1. A composition of matter consisting essentially of 80 ±1 weight percent hydrogenated norbornadiene dimer and 20 ±1 weight percent of a butylbenzene.

2. A composition of matter according to claim 1 wherein the butylbenzene is iso-butylbenzene.

* * * * *